US008224005B2

(12) United States Patent
Smith

(10) Patent No.: US 8,224,005 B2
(45) Date of Patent: Jul. 17, 2012

(54) HEARING AID EXTENSION

(75) Inventor: Richard C. Smith, Costa Mesa, CA (US)

(73) Assignee: Surefire, LLC, Fountain Valley, CA (US)

( * ) Notice: Subject to any disclaimer, the term of this patent is extended or adjusted under 35 U.S.C. 154(b) by 1207 days.

(21) Appl. No.: 11/868,686

(22) Filed: Oct. 8, 2007

(65) Prior Publication Data

US 2009/0052710 A1 Feb. 26, 2009

Related U.S. Application Data

(63) Continuation-in-part of application No. 11/844,794, filed on Aug. 24, 2007.

(51) Int. Cl.
*H04R 25/00* (2006.01)
*H04R 25/02* (2006.01)

(52) U.S. Cl. ..... 381/322; 381/328; 181/130

(58) Field of Classification Search ..... 381/322, 381/328, 380, 381, 312; 181/130
See application file for complete search history.

(56) References Cited

U.S. PATENT DOCUMENTS

| | | | | |
|---|---|---|---|---|
| 2,430,229 | A * | 11/1947 | Kelsey | 381/338 |
| 4,712,245 | A * | 12/1987 | Lyregaard | 381/324 |
| 6,724,902 | B1 * | 4/2004 | Shennib et al. | 381/328 |
| 7,027,608 | B2 * | 4/2006 | Fretz et al. | 381/330 |
| 2008/0137891 | A1 * | 6/2008 | Vohringer | 381/328 |

* cited by examiner

*Primary Examiner* — Curtis Kuntz
*Assistant Examiner* — Sunita Joshi
(74) *Attorney, Agent, or Firm* — Haynes and Boone, LLP

(57) ABSTRACT

Systems and methods are disclosed for enhancing the performance of hearing aids and the like. For example, an extension for a hearing aid can include a stem having one or more flanges formed thereon. The flanges can be configured to enhance the fit of the hearing aid in the ear canal. The extension can cushion sensitive tissues of the ear canal from contact with the hard plastic inner end of the hearing aid. The extension also inhibits undesirable leakage of sound around the hearing aid. Thus, both comfort and effectiveness of a hearing aid or the like are enhanced.

23 Claims, 3 Drawing Sheets

HEARING AID EXTENSION

RELATED APPLICATION

This patent application is a continuation-in-part (CIP) patent application of U.S. patent application Ser. No. 11/844,794, filed on Aug. 24, 2007 and entitled Hearing Aid Sleeve, the entire contents of which are hereby expressly incorporated by reference.

TECHNICAL FIELD

The present invention relates generally to audiology. The present invention relates more particularly to an extension for completely-in-the-ear (CIC) hearing aids that makes the hearing aids more effective, as well as more comfortable to wear and less likely to fall out.

BACKGROUND

Hearing aids for enhancing the ability of the hearing impaired to hear are well known. Hearing aids have a microphone, an amplifier, a battery, and speaker. The microphone picks up ambient sound, such as voices. The amplifier increases the intensity of at least selected portions of the sound so that it can more easily be heard. The battery provides power to the amplifier. The speaker converts an electronic signal from the amplifier into sound at the user's ear.

Some hearing aids include a filter that tends to reject non-voice sounds. The use of a filter helps make voice more intelligible by at least partially eliminating sound that can interfere with voice. As those skilled in the art will appreciate, some sounds can interfere with voidce in a manner that makes voice more difficult to hear and understand.

Some hearing aids are analog devices and some hearing aids are digital devices. Analog hearing aids use analog electronic circuitry to amplify and/or filter sound. Digital hearing aids use digital circuitry to amplify and/or filter sound. The use of digital circuitry can provide enhanced control over the hearing aid's ability to reject unwanted sounds.

Some hearing aids have the microphone, amplifier, battery, and filter located behind the ear and are therefore referred to as behind-the-ear (BTE) hearing aids. Such hearing aids also have a portion that is in the ear. The portion in the ear contains the speaker. The speaker can be located in the conchae or the ear canal.

Some hearing aids are disposed entirely within the ear and are known as in-the-ear (ITE) hearing aids. A portion of the hearing aid can be located within the conchae and another portion of the hearing aid can be located within the ear canal. Typically, the microphone, amplifier, battery, and filter of ITE hearing aids are located in the conchae and the speaker is located within the ear canal.

Some hearing aids are disposed entirely within the ear canal and are known as completely-in-the-canal (CIC) hearing aids. The microphone, amplifier, battery, speaker, and filter are all disposed in the ear canal of the user.

Generally, at least a portion of the speaker is disposed in the ear canal regardless of the type of hearing aid. The entire speaker and other components of the hearing aid can be disposed either completely or partially in the ear canal.

Although such contemporary hearing aids have proven generally suitable for their intended purposes, they possess inherent deficiencies which detract from their overall desirability and effectiveness. For example, the speaker and any other components of a contemporary hearing aid that are to be disposed in the ear canal are commonly contained within a rigid plastic housing. The rigid plastic housing can press upon and/or abrade sensitive tissues of the ear canal. This can result in irritation and/or damage to these tissues. Further, contemporary hearing aids do not deliver sound sufficiently close to the eardrum so as to be as effective as desired. Further, contemporary hearing aids are undesirably subject to loosening and even falling out of the ear.

Further, the rigid plastic housing does not typically seal well against the ear canal, thus allowing unfiltered ambient sound to reach the eardrum. The unfiltered ambient sound includes noise that would otherwise have been mitigated by the hearing aid's filter. This noise makes voice less intelligible and thereby adversely affects the effectiveness of the hearing aid.

Improper sealing of the hearing aid with respect to the ear canal can also allow amplified sound to escape from the ear canal and be picked up with the hearing aid's microphone. This can result in positive feedback that causes a squeal. The squeal can be very loud to the hearing aid wearer and is extremely annoying.

As such, although the prior art has recognized, to a limited extent, problems associated with the use of hearing aids, the proposed solutions have, to date, been ineffective in providing a satisfactory remedy. Therefore, it is desirable to provide an improvement to hearing aids and the like that enhances the comfort and effectiveness thereof.

BRIEF SUMMARY

Systems and methods are disclosed herein to enhance the comfort, effectiveness, and performance of hearing aids and the like. More particularly, an embodiment of an extension for a hearing aid can comprise a layer of resilient material that is configured to cover at least an inner portion of a hearing aid and that is configured to be inserted into a user's ear canal and can also comprise a strap that is configured to hold the extension onto the hearing aid.

An embodiment can comprise a hearing aid assembly comprising a hearing aid having at least a portion that is configured to be disposed within a user's ear canal and can also comprise an extension attached to the hearing aid. The extension can comprise a layer of resilient material that is configured to cover at least an inner portion of a hearing aid and that is configured to be inserted into a user's ear canal and can also comprise a strap that is configured to hold the extension onto the hearing aid.

An embodiment can comprise a completely-in-the-canal (CIC) hearing aid assembly comprising a completely-in-the-canal (CIC) hearing aid and an extension. The extension can comprise a layer of resilient material that is configured to cover at least an inner portion of a hearing aid and that is configured to be inserted into a user's ear canal and can also comprise a strap configured to hold the extension onto the hearing aid.

An embodiment can comprise an extension for a hearing aid, wherein the extension comprises means for covering at least an inner portion of a hearing aid and also comprises means, such as a strap, for holding the extension onto the hearing aid.

An embodiment can comprise a method for making an extension for a hearing aid, wherein the method comprises injection molding a resilient material so as to form a layer of resilient material that is configured to cover at least an inner portion of a hearing aid and forming a strap to the resilient material. The strap can be configured to attach the extension to the hearing aid. The strap can be formed either separately form the extension or integrally therewith.

An embodiment can comprise an extension for a wireless receiver, wherein the extension comprises a layer of resilient material configured to cover at least an inner portion of a hearing aid and configured to be inserted into a user's ear canal and a strap configured to hold the extension onto the hearing aid.

Benefits include more comfortable use of hearing aids and the like. Comfort is enhanced because the resilient layer cushions sensitive tissue of the ear canal. Flanges can further enhance comfort. The extension, particularly the flanges thereof, can enhance the fit of the hearing aid so as to make the hearing aid substantially less likely to loosen and/or fall out.

Benefits also include more effective use of hearing aids as the like. The resilient layer and/or the flanges better seal the ear canal so as to substantially inhibit the leakage of ambient noise around the hearing aid and into the ear, as well as to similarly substantially mitigate the leakage of amplified sound around the hearing aid and to the microphone thereof in a manner that cause squealing. The extension can also deliver sound closer to the eardrum so as to enhance the effectiveness of a hearing aid or the like.

This invention will be more fully understood in conjunction with the following detailed description taken together with the following drawings.

BRIEF DESCRIPTION OF THE DRAWINGS

Embodiments of the present invention and their advantages are best understood by referring to the detailed description that follows. It should be appreciated that like reference numerals are used to identify like elements illustrated in one or more of the figures.

DETAILED DESCRIPTION

Figure 1:
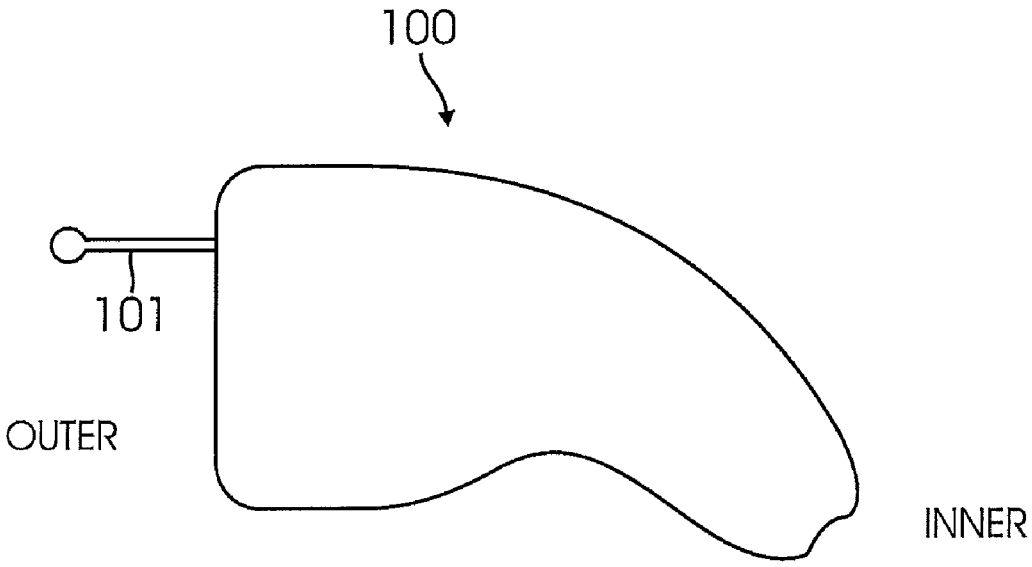
FIG. 1 (Prior Art)
FIG. 1 is a semi-schematic side view of a contemporary completely-in-the-ear (CIC) hearing aid.

A method and system for enhancing the comfort and effectiveness of hearing aids, wireless receivers, music players, and the like are disclosed. According to one embodiment, an extension for a hearing aid comprises a stem that optionally has one or more flanges formed thereon and that also has a strap or the like formed thereto. The strap or other structure holds the extension to the hearing aid or other audio device. For example, the strap can generally encircle the audio device.

The strap does not need to be an elongated structure. The strap does not need to completely encircle the audio device. Rather, the strap can be any structure that attaches the extension to a hearing aid or the like. For example, the strap can be snap to or otherwise attach to the audio device without encircling the audio device.

The stem can have an opening, depression or other structure formed in the outer end thereof. This structure is configured to receive the inner end of a hearing aid. The strap holds the extension to the hearing aid.

The stem, flanges, and strap can be integrally formed of a resilient material. The resilient material can comprise rubber, such as silicone rubber. Alternatively, the resilient material can comprise any other resilient biocompatible material. The resilient material can have a Shore A durometer of between approximately 35 and approximately 45. For example, the resilient material can have a Shore A durometer of approximately 40.

The stem, flanges, and strap can be integrally formed by molding. For example, the stem, flanges, and strap can be injection molded as a single unit. Alternatively, the stem, flanges, and/or strap can be formed separately and then attached to one another such as via ultrasonic welding or adhesive bonding.

The strap, flanges, and/or stem can be formed of different materials. The strap can be formed of a non-resilient material. For example, the stem and flanges can be formed of a resilient material such as silicon rubber and the strap can be formed of a non-resilient fabric such as acrylonitrile butadiene styrene (ABS), polycarbonate, or polyvinyl chloride (PVC). The strap can be formed of a fabric, such as cloth.

One or more flanges can optionally be formed to the stem. For example, one, two, three, four, five, or more flanges can be formed to the stem. The flanges can be substantially identical to one another. Alternatively, the flanges can be different with respect to one another. For example, the flanges can be of different sizes and shapes. The flanges can be generally circular, oval, ellipsoidal or of any other shape. Generally, the size and shape of the flanges will correspond to the size and shape of a user's ear canal. The flanges can be formed concentrically or eccentrically with respect to the shaft. In this manner, the flanges can be formed such that they enhance the comfort and sealing provided thereby.

The flanges can enhance the fit, comfort, and effectiveness of the hearing aid. Fit and comfort are enhanced by conforming the size and shape of inner end of the hearing aid to the size and shape of the ear canal via use of the extension. For example, the size and shape of the flanges of the extension can conform to and provide a proper fit with the ear canal. Effectiveness is enhanced by mitigating leakage of sound around the hearing aid and through the ear canal.

Effectiveness can also be enhanced by delivering sound closer to the eardrum. That is, the inner end of the extension can be placed closer to the eardrum than the inner end of the hearing aid. Thus, sound from the hearing aid can be more intelligible and/or the volume of the hearing aid can be reduced. Reducing the volume of the hearing aid is advantageous because operation at reduced volume can lengthen battery life. Reducing the volume of the hearing aid is also advantageous because reduced volume reduces the likelihood of positive feedback which results is undesirable squealing, as discussed above.

Various embodiments of the extension can be used with a variety of different hearing devices such as hearing aids, earphones, and wireless receivers. For example, embodiments can be used with hearing aids such as behind-the-ear (BTE), in-the-ear (ITE), and completely-in-the-canal (CIC) hearing aids. Embodiments can be used with earphones for cellular telephones, as well as music players such as MP3® players and iPods®. Embodiments can be used with wireless receivers such as those can be placed within the ear canal to facilitate the reception of covert communications. The term "hearing aid" can be used generically herein to refer to all such devices.

Optionally, a diaphragm or other obstruction can seal or partially seal an inner end of the extension so as to prevent soiling of the hearing aid with earwax. The diaphragm can be formed of the same material as the extension. The diaphragm can be integrally formed with the extension. The diaphragm can be sufficient thin so as to readily facilitate the transmission of sound therethrough.

The resilient material of the insert inhibits contact of the inner end of the hearing aid with delicate tissues of the ear canal. Thus, the resilient material covers some of those portions of the hearing aid that would otherwise contact tissue of the ear canal. The resilient material can cover an inner portion of the hearing aid. The resilient material can cover substantially all of the hearing aid. The resilient material can cover any desired portion of the hearing aid.

The resilient material can be flesh colored. All of the resilient material or some portion thereof, such as the strap, can be flesh colored. The resilient material can be generally transparent. The resilient material can be of any desired color.

Figure 2:
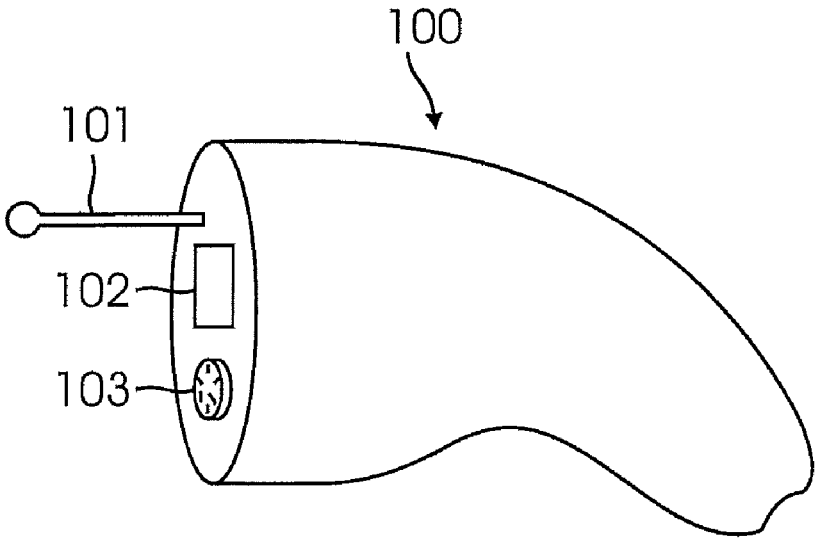
FIG. 2 (Prior Art)
FIG. 2 is a semi-schematic perspective view of the CIC hearing aid of FIG. 1.

Referring now to FIGS. 1 and 2, a contemporary completely-in-the-ear (CIC) hearing aid 100 is configured to fit within the ear canal of a user. Such CIC hearing aids are generally curved so as to better conform to the shape of the ear canal.

With particular reference to FIG. 2, contemporary CIC hearing aids typically comprise a stem 101 that extends away from the outer end thereof so as to facilitate insertion of the hearing aid 100 into and removal of the hearing aid 100 from the user's ear canal. The user can grasp the stem 101 between the forefinger and thumb for facilitate insertion and removal from the ear canal.

Contemporary CIC hearing aids also typically comprise a battery compartment 102 within which a replaceable/rechargeable battery is disposed. They also typically comprise a volume control 103 that facilitates adjustment to the volume of the hearing aid 100.

Figure 3:
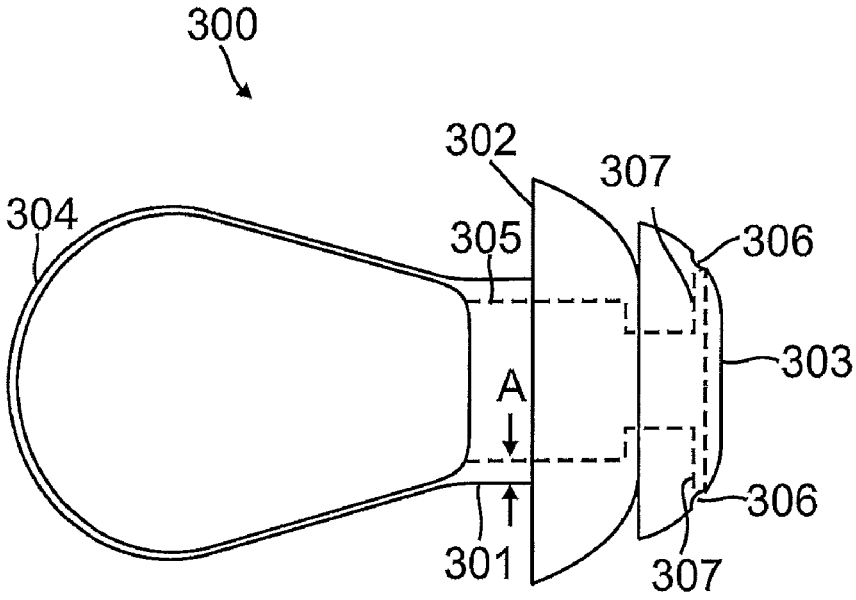
FIG. 3 is a semi-schematic side view of a hearing aid extension with dashed lines indicating the hollow cavity within which the inner end of a hearing aid can be inserted and through which sound travels, according to an exemplary embodiment.
Figure 4:
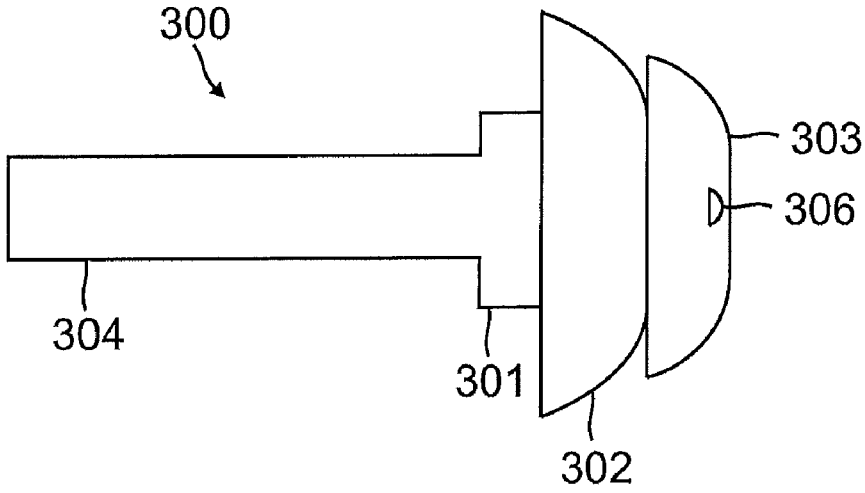
FIG. 4 is a semi-schematic side view of the extension of FIG. 3 rotated ninety degrees about the longitudinal axis thereof.
Figure 5:
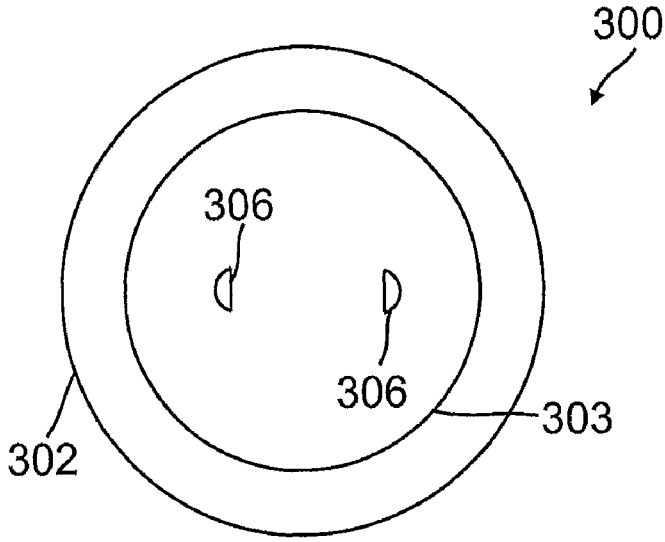
FIG. 5 is a semi-schematic end view of the extension of FIG. 3.

Referring now to FIG. 3-5, an extension 300 can comprise a generally hollow stem 301 that is configured to slip over the inner end of a completely-in-the-ear (CIC) hearing aid or the like. The stem 301 can have an opening formed in the outer end thereof so as to define a bore 305 for receiving the inner end of the hearing aid. A strap 304 can attach the stem 301 to the hearing aid.

One or more flanges 302 and 303 can be formed upon stem. The flanges 302 and 303 enhance the fit of the extension 300 in the ear canal and thus enhance the comfort and effectiveness of the hearing aid.

Optionally, the extension can be made resistant to soiling, such as by earwax. For example, instead of having the bore 305 simply extend completely through the stem 301, the bore 305 can communicate with one or more smaller bores 306 that define openings 306 in the inner end of the extension. The use of such smaller opening substantially mitigates the introduction of earwax and the like into the bore 305.

Figure 6:
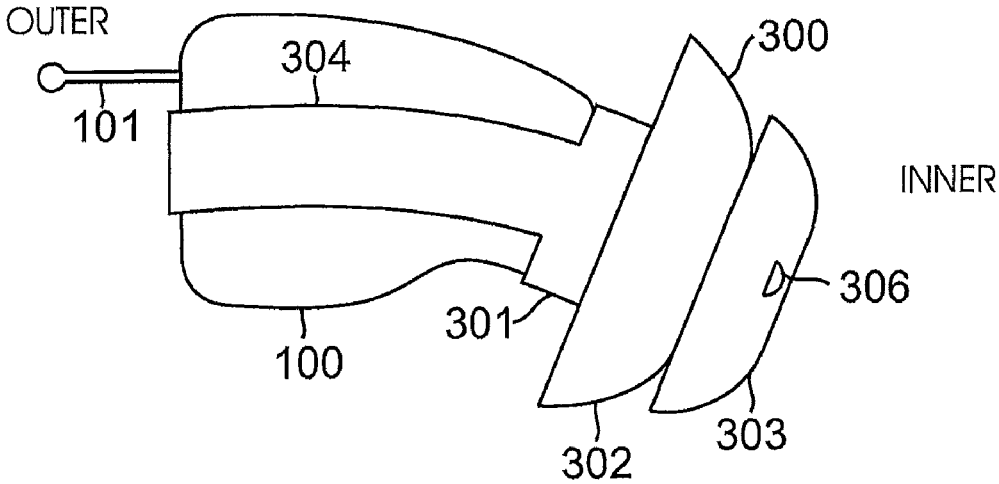
FIG. 6 is a semi-schematic perspective side view of the extension of FIG. 3 installed upon the hearing aid of FIG. 1.

Referring now to FIG. 6. the extension 300 is shown installed upon a CIC hearing aid 100. The extension covers an inner portion of the CIC hearing aid 100. The strap 304 wraps around the outer end of the hearing aid so as to hold the extension upon the hearing aid. The strap can similarly be configured to hold the extension onto a variety of different audio devices that are disposed at least partially within the ear.

The strap can have a variety of different configurations. More than one strap can be used. For example, one, two, three, four, or more straps can be used. A strap can attached to any part of the hearing aid 100 that attaches the extension to the hearing aid 100. The strap can attach to the hearing aid in any manner that attaches the extension 300 to the hearing aid 100.

The stem of the extension can be formed of a resilient material having a thickness of between approximately 0.001 inch and approximately 0.100 inch. For example, the resilient material can have a thickness of approximately 0.050 inch.

The flange(s) can enhance sealing of the extension 300, and consequently of the hearing aid, with respect to the ear canal. Such sealing enhances the ability of the extension to inhibit the communication of ambient sound around the hearing aid and through the ear canal to the eardrum. Such sealing also enhances the ability of the extension to inhibit the communication of amplified sound around the hearing aid and through the ear canal to the hearing aid's microphone. Both of such communications are undesirable, as discussed herein.

The flange(s) can also enhance comfort by providing a soft, resilient surface for contact with sensitive tissues of the ear canal. For example, the hearing aid can be substantially undersized with respect to the ear canal and the flange(s) can fill in the additional space thus created between the hearing aid the ear canal. Thus, use of the flange(s) allows one size of hearing aid to fit a larger range of sizes of ear canals.

A soiled extension 300 can be removed from the hearing aid and then simply be cleaned with soap and water. An extension 300 can be immersed in water without fear of damage. Thus, the use of an extension allows the hearing aid 100 to remain comparatively clean while also allowing the soiled covering to be easily cleaned.

Embodiments of the present invention can be used with various types of hearing aids and the like, including behind-the-hear (BTE), in-the-ear (ITE), and completely-in-the-canal (CIC) hearing aids. The hearing aids can be any hearing aids wherein at least a portion thereof is disposed within the ear canal. Embodiments can also be used with wireless receivers such as those worn in the ear canal by covert operatives. Wireless receivers are substantially similar to CIC hearing aids in appearance. The CIC hearing aids of FIGS. 1 and 2 can also be considered to be wireless receivers.

Embodiments can also be used with small speakers, such as those of music players, e.g., iPods® and MP3® players. Such speakers can be located outside of the ear canal (such as in the conchae), partially within the ear canal, or entirely within the ear canal. Embodiments can be used with any devices that fit at least partially within the ear, particularly the ear canal.

One or more embodiments provide more comfortable use of hearing aids and the like. Comfort is enhanced because the resilient layer cushions sensitive tissue of the ear canal. Flanges and/or foam can further enhance comfort. In this manner, pressure and abrasion of the sensitive tissue is mitigated so as to likewise mitigate the occurrence of irritation and damage to the ear canal.

One or more embodiments enhance the effectiveness of hearing aids and the like by mitigating the leakage of undesirable sound into the ear. The resilient layer and the flanges better seal the ear canal so as to substantially inhibit the leakage of ambient noise around the hearing aid and into the ear canal such the likelihood of ambient noise interfering with speech is substantially inhibited. Thus, speech is more intelligible.

One or more embodiments enhance the effectiveness of hearing aids by mitigating the leakage of amplified sound out the ear. Thus, the amplified sound is inhibited from reaching the hearing aid's microphone where it can be picked up and re-amplified in a manner that results in the generation of an annoying squeal.

One or more embodiments can inhibit soiling of the hearing aid by proving an effective covering therefor. Thus, maintenance of the hearing aid is simplified and hygiene is improved. Maintenance is simplified by providing a covering that is soiled instead of the hearing aid itself being soiled. The covering is easily cleaned. Because the covering is easily cleaned, it is like to be cleaned better and more frequently, thus enhancing hygiene.

One or more embodiments facilitate the use of a given, e.g., smaller size, hearing aid with a larger range of ear sizes by functioning as an adapter between the hearing aid and the ear canal. Embodiments with or without flanges can be configured to make the shape and size of a hearing aid better conform to the shape and size of the ear canal. By allowing a given size of hearing aid to fit a larger range of ear sizes, fewer sizes of hearing aids need to be stocked. By enhancing the fit of the hearing aid, the extension can facilitate more secure positioning of the hearing aid within the ear canal and can thus reduce the likelihood of loss of the hearing aid.

One or more embodiments deliver sound closer to the eardrum so as to enhance the effectiveness of the hearing aid. Delivering sound closer to the eardrum can allow the sound of an audio device to be lowered, thus conserving battery power. Lowering of the sound of an audio device can reduce the likelihood of the audio device distracting or annoying others.

Embodiments described above illustrate, but do not limit, the invention. It should also be understood that numerous modifications and variations are possible in accordance with the principles of the present invention. Accordingly, the scope of the invention is defined only by the following claims.

The invention claimed is:

1. An extension for a hearing aid, the extension comprising:

a resilient hollow stem having an outer end configured to receive an inner end of the hearing aid and configured to be inserted into a user's ear canal; and a strap extending longitudinally from the outer end to form a loop configured to cooperate with the stem to encircle substantially the entire hearing aid to hold the extension onto the hearing aid.

2. The extension as recited in claim 1, wherein a layer of resilient material defines a stem.

3. The extension as recited in claim 1, wherein the extension is configured for use with a completely-in-the-ear (CIC) hearing aid.

4. The extension as recited in claim 1, further comprising a first bore formed through the stem and a plurality of second bores formed generally perpendicularly with respect to the first bore and defining openings formed in the inner end of the extension that are in communication with the first bore.

5. The extension as recited in claim 1, wherein the stem comprises rubber.

6. The extension as recited in claim 1, wherein the stem comprises silicone rubber.

7. The extension as recited in claim 1, wherein the stem has a Shore A durometer of between approximately 35 and approximately 45.

8. The extension as recited in claim 1, wherein the stem has a Shore A durometer of approximately 40.

9. The extension as recited in claim 1, further comprising at least one flange formed to the stem.

10. The extension as recited in claim 1, further comprising at least one flange formed integrally with the stem.

11. The extension as recited in claim 1, further comprising a plurality of flanges formed to the stem.

12. The extension as recited in claim 1, wherein the extension is configured to at least partially cover a completely-in-the-ear (CIC) hearing aid.

13. The extension as recited in claim 1, wherein the stem has a thickness of between approximately 0.001 inch and approximately 0.100 inch.

14. The extension as recited in claim 1, wherein the stem has a thickness of approximately 0.050 inch.

15. The extension as recited in claim 1, wherein the stem is curved so as to generally conform to a curvature of the ear canal.

16. The extension as recited in claim 1, wherein the stem is flesh colored.

17. A hearing aid assembly comprising:

a hearing aid having at least a portion that is configured to be disposed within a user's ear canal; and an extension attached to the hearing aid, the extension comprising:

a resilient hollow stem having an outer end configured to receive an inner end of the hearing aid and configured to be inserted into a user's ear canal; and a strap extending longitudinally from the outer end to form a loop configured to cooperate with the stem to encircle substantially the entire hearing aid to hold the extension onto the hearing aid.

18. A completely-in-the-canal (CIC) hearing aid assembly comprising:

a completely-in-the-canal (CIC) hearing aid;

an extension comprising:

a resilient hollow stem having an outer end configured to receive an inner end of the hearing aid and configured to be inserted into a user's ear canal; and a strap extending longitudinally from the outer end to form a loop configured to cooperate with the stem to encircle substantially the entire hearing aid to hold the extension onto the hearing aid.

19. A method for making an extension for a hearing aid, the method comprising:

injection molding a resilient material so as to form a hollow stem having an outer end that is configured to receive an inner end of the hearing aid;

forming a strap to the resilient material; and wherein the strap is configured to extend longitudinally from the outer end to cooperate with the stem to encircle substantially the entire hearing aid to attach the extension to the hearing aid.

20. An extension for a wireless receiver, the extension comprising:

a resilient hollow stem having an outer end configured to receive an inner end of the wireless receiver and configured to be inserted into a user's ear canal; and a strap extending longitudinally from the outer end to form a loop configured to cooperate with the stem to encircle substantially the entire wireless receiver to hold the extension onto the wireless receiver.

21. An extension for an audio device, the extension comprising:

a resilient hollow stem having an outer end configured to receive an inner end of a speaker of the audio device and configured to be inserted into a user's ear canal; and a strap extending longitudinally from the outer end to form a loop configured to cooperate with the stem to encircle substantially the entire audio device to hold the extension onto the speaker.

22. The extension as recited in claim 21, wherein the audio device comprises a cellular telephone.

23. The extension as recited in claim 21, wherein the audio device comprises a music player.

* * * * *